US010306346B2

(12) United States Patent
Liu et al.

(10) Patent No.: US 10,306,346 B2
(45) Date of Patent: May 28, 2019

(54) SPEAKER HOUSING AND SPEAKER UNIT

(71) Applicant: Goertek Inc., Weifang (CN)

(72) Inventors: Huawei Liu, Weifang (CN); Zhilei Han, Weifang (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 15/770,858

(22) PCT Filed: Dec. 9, 2015

(86) PCT No.: PCT/CN2015/096757

§ 371 (c)(1),
(2) Date: Apr. 25, 2018

(87) PCT Pub. No.: WO2017/071009

PCT Pub. Date: May 4, 2017

(65) Prior Publication Data

US 2018/0310083 A1 Oct. 25, 2018

(30) Foreign Application Priority Data

Oct. 27, 2015 (CN) ..... 2015 2 0840526 U

(51) Int. Cl.
*H04R 1/02* (2006.01)
*H04R 1/06* (2006.01)
(Continued)

(52) U.S. Cl.
CPC ..... *H04R 1/025* (2013.01); *H04R 1/06* (2013.01); *H04R 9/02* (2013.01); *H04R 9/025* (2013.01);
(Continued)

(58) Field of Classification Search
CPC . H04R 1/025; H04R 1/06; H04R 9/02; H04R 9/025; H04R 9/045; H04R 9/06; H04R 2499/11
See application file for complete search history.

(56) References Cited

U.S. PATENT DOCUMENTS

2008/0253590 A1 10/2008 Sun

FOREIGN PATENT DOCUMENTS

CN 202488688 U 10/2012
CN 104144373 A * 11/2014
(Continued)

OTHER PUBLICATIONS

International Search Report dated Jul. 19, 2016 in PCT/CN2015/096757.

*Primary Examiner* — Sunita Joshi
(74) *Attorney, Agent, or Firm* — Venable LLP; Michele V. Frank

(57) ABSTRACT

A speaker housing comprises an enclosing side wall frame and a washer. A portion enclosed by the side wall frame is an inner side of the side wall frame. The washer is integrated with the side wall frame by injection molding, and at least a part of the washer is exposed at the inner side of the side wall frame. A seam is formed between a surface of the washer exposed at the inner side of the side wall frame and a surface of the side wall frame. Recesses are formed in surfaces of the washer and the side wall frame at two sides of the seam. Further provided is a speaker unit comprising the above speaker housing. A technical effect of the present application is to prevent a plastic burr extending from the seam between the washer and the side wall frame from affecting the speaker.

7 Claims, 2 Drawing Sheets

(51) Int. Cl.

| | |
|---|---|
| ***H04R 9/02*** | (2006.01) |
| ***H04R 9/04*** | (2006.01) |
| ***H04R 9/08*** | (2006.01) |
| ***H04R 9/06*** | (2006.01) |

(52) U.S. Cl.
CPC ..... *H04R 9/045* (2013.01); *H04R 9/06* (2013.01); *H04R 2499/11* (2013.01)

(56) References Cited

FOREIGN PATENT DOCUMENTS

| | | | |
|---|---|---|---|
| CN | 104144373 | A | 11/2014 |
| CN | 104185127 | A | 12/2014 |
| CN | 204069318 | U | 12/2014 |

* cited by examiner

SPEAKER HOUSING AND SPEAKER UNIT

CROSS-REFERENCE TO RELATED APPLICATIONS

This application is a National Stage of International Application No. PCT/CN2015/096757, filed on Dec. 9, 2015, which claims priority to Chinese Patent Application No. 201520840526.0, filed on Oct. 27, 2015, both of which are hereby incorporated by reference in their entireties.

FIELD OF THE INVENTION

The present application belongs to the technical field of micro speakers and particularly relates to a speaker housing and a speaker unit.

BACKGROUND OF THE INVENTION

With continuous development of electronics, micro speakers, as important acoustic components in modern consumer electronics, have been rapidly improved in performance. Enhancing the sound performance of the speakers often needs increasing the size of magnetic circuit systems. However, such electronics as mobiles phones and tablet computers have limitations on the sizes of the micro speakers to some extent. Therefore, in order to increase the size of the magnetic circuit system, those skilled in the art usually balance the size increase by thinning a housing.

However, the above-mentioned technical means of thinning the housing may easily cause reduction of the strength of the housing, which results in reduction of the reliability of the speaker. Hence, those skilled in the art further employ a method of directly disposing a part of a washer in the housing by injection molding so as to achieve the objectives of increasing the size of the magnetic circuit system and guaranteeing the strength of the housing. Nevertheless, due to manufacturing tolerance of the size of the washer, it is inevitable that plastic burrs appear at the splicing portion of the washer and the plastic housing during the integral injection molding process. So, it is possible that these burrs extend into a magnetic gap or other structures of a speaker unit to affect the acoustic performance, the assembly process and the structural stability of the speakers.

To sum up, in order to guarantee the acoustic performance of the micro speakers, it is necessary to avoid the influence on the speaker unit from the extending plastic burrs. Therefore, the housing integrated with the washer by injection molding needs to be improved. Or, a new technical scheme may be employed to prevent the plastic housing from burrs.

SUMMARY OF THE INVENTION

An objective of the present application is to prevent an extending plastic burr from affecting a speaker unit.

According to an aspect of the present application, there is provided a speaker housing, comprising: an enclosing side wall frame and a washer. A portion enclosed by the side wall frame is an inner side of the side wall frame. The washer is integrated with the side wall frame by injection molding, at least a part of the washer is exposed at the inner side of the side wall frame, and a seam is formed between a surface of the washer exposed at the inner side of the side wall frame and a surface of the side wall frame. Recesses are formed in surfaces of the washer and the side wall frame at two sides of the seam.

Preferably, the recesses may be formed at two sides of the seam facing the inner side of the side wall frame.

Preferably, the recesses may also be formed at two sides of the seam facing the upper portion or the lower portion of the side wall frame.

Optionally, the seam may be located at two ends of the washer respectively.

Particularly, the side wall frame may be of a rectangular frame structure. More preferably, the speaker housing may comprise four washers respectively located at the four edges of the side wall frame.

Preferably, the side wall frame may be provided with a portion for supporting washer located on the inner side of the side wall frame. The washer is disposed in the portion for supporting washer by injection molding.

Furthermore, there is also provided a speaker unit, comprising the above-mentioned speaker housing, a magnetic circuit system disposed on the inner side of the side wall frame and a vibrating component disposed on the speaker housing. A magnetic gap is formed between the magnetic circuit system and the washer.

A technical effect of the present application lies in that a dent is formed around the seam by the recesses, so that the seam sinks a certain depth into the side wall frame. Accordingly, a plastic burr extending from the seam is prevented from affecting the sound performance of the speaker.

Further features of the present application, as well as advantages thereof, will become apparent from the following detailed description of exemplary embodiments of the present application with reference to the attached drawings.

BRIEF DESCRIPTION OF THE DRAWINGS

The accompanying drawings, which are incorporated in and constitute a part of the specification, illustrate embodiments of the present application and, together with the description, serve to explain the principles of the present application.

DETAILED DESCRIPTION OF THE EMBODIMENTS

Figure 1:
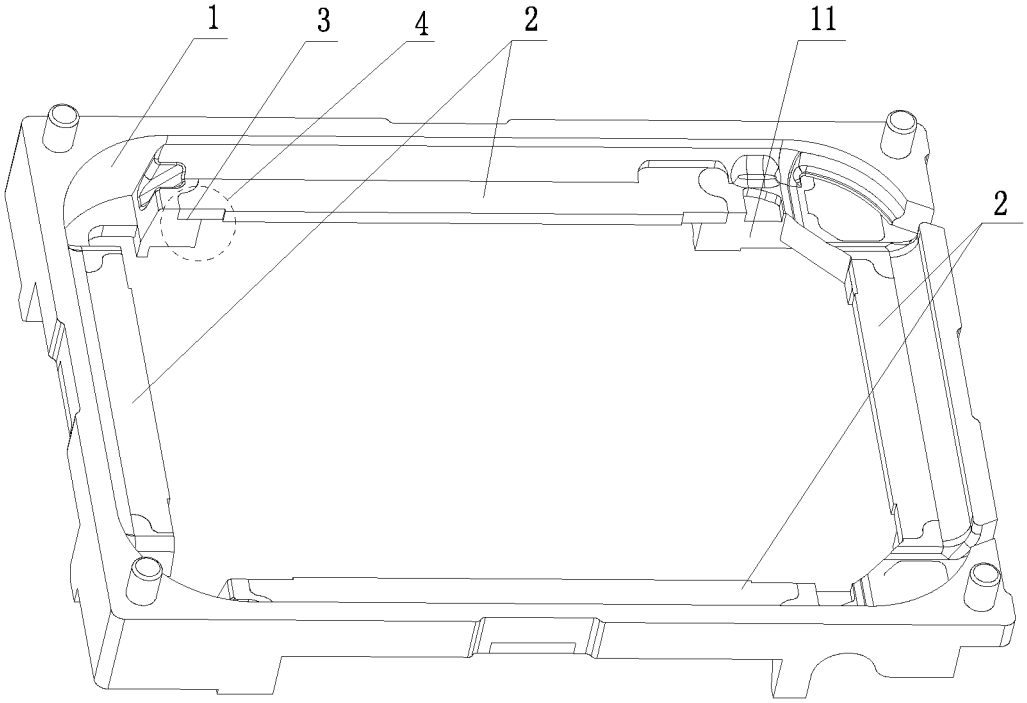
FIG. 1 is a solid structural view of a speaker housing in one embodiment of the present application.

Various exemplary embodiments of the present application will now be described in detail with reference to the accompanying drawings. It should be noted that the relative arrangement of the components and steps, numerical expressions and numerical values set forth in these embodiments do not limit the scope of the present application unless it is specifically stated otherwise.

The following description of at least one exemplary embodiment is merely illustrative in nature and by no means is to be construed as any limitation on the present application and its application or use.

Techniques, methods, and apparatuses known to one of ordinary skill in the relevant art may not be discussed in detail but, where appropriate, the techniques, methods, and apparatuses should be considered part of the description.

In all of the examples shown and discussed herein, any specific value should be interpreted as merely illustrative and not as a limitation. Therefore, other examples of the exemplary embodiments may have different values.

It should be noted that like reference numbers and letters represent similar terms in the following figures, and therefore, an item needs not to be further discussed in subsequent figures as soon as it is defined in a previous drawing.

The present application provides a speaker housing, comprising a side wall frame. The side wall frame is enclosed to form a closed structure. A portion enclosed by the side wall frame is an inner side of the side wall frame. A washer is integrated with the side wall frame by injection molding, and at least a part of the washer is exposed at the inner side of the side wall frame. For example, the lower surface and a part of a side wall of the washer may be disposed in the side wall frame by injection molding. Another side surface and the upper surface of the washer are exposed at the inner side of the side wall frame. A seam is formed between a surface of the washer exposed at the inner side of the side wall frame and a surface of the side wall frame. At the seam, the side wall frame has high probability of producing a plastic burr extending outwards. Particularly, recesses are formed in surfaces of the washer and/or the side wall frame at two sides of the seam and sink a certain depth into the side wall frame respectively, so that an inward concave stepped structure is formed around the seam. Owing to the recesses, the seam is recessed into the side wall frame to a certain degree and kept a small distance away from the original positions of the washer and the side wall frame. The length of the distance is generally larger than the extending length of the plastic burr. Thus, even if the plastic burr extends from the seam, it may not extend to the original positions of the washer and the side wall frame. Surfaces of the washer and the side wall frame in the original positions serve as a contact surface for assembly and surfaces of such structures as a magnetic gap. The plastic burr can neither extend to these positions nor affect the assembly or the performance of the speaker.

Figure 2:
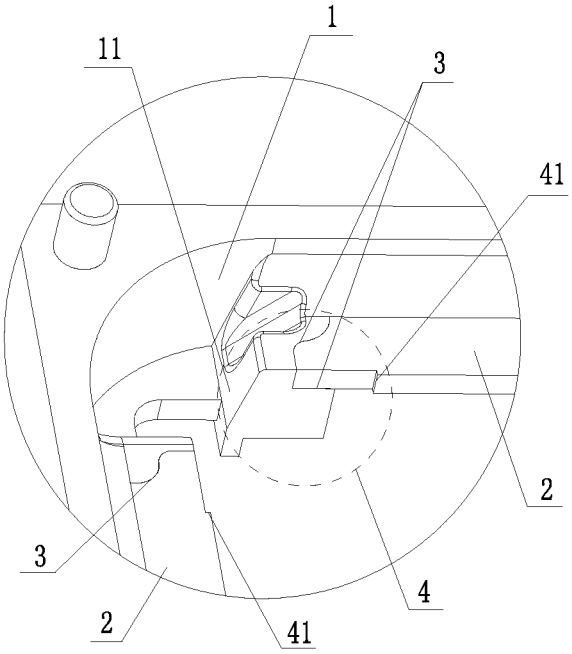
FIG. 2 is a partial enlarged view of FIG. 1.
Figure 3:
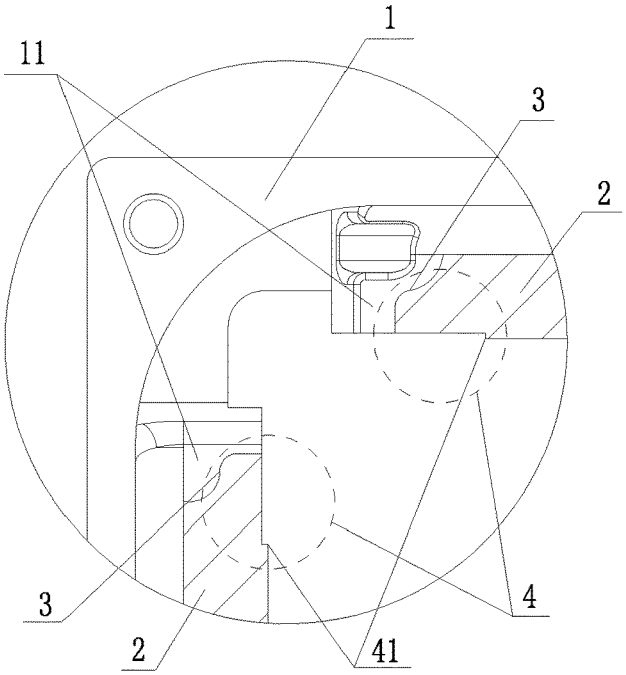
FIG. 3 is a partial top view of a speaker housing in one embodiment of the present application.

Particularly, as shown in FIGS. 1 to 2, in one embodiment of the present application, the side wall frame 1 is enclosed to form a rectangular frame structure. The washer 2 is disposed at the edge, close to the inner side, of the side wall frame 1 by injection molding. The side, facing the inner side of the side wall frame 1, and the upper side of the washer 2 are exposed at the inner side of the side wall frame 1. The seam 3 extends from the edge of the upper surface of the washer 2 to a side surface. A part of the seam 3 extends to the lower surface of the washer 2. Particularly, as shown in FIGS. 2 to 3, the recesses 4 are formed around the seam 3 on a side surface of the washer 2. Each recess 4 comprises a stepped structure 41 formed on the side surface of the washer 2 and extends onto the side wall frame 1 from the corresponding stepped structure 41 via the seam 3. The whole recesses 4 sink into the side wall frame 1, so that the seam 3 is a certain distance away from the original side position of the washer 2.

Particularly, in the embodiments illustrated by the FIGS. 1 to 3, the stepped structure 41 is only formed on the washer 2 while the inner surface of the side wall frame 1 is free from a stepped structure. That is, the inner surface of the side wall frame 1 around the seam 3 is not restored to the original position. In other embodiments of the present application, stepped structures of the recesses may be disposed on both of the washer and the side wall frame at two sides of the seam. It means that the recesses form a groove or a pit to allow the seam to sink therein. Alternatively, the stepped structure is only disposed on the side wall frame. The recesses extend onto the washer from the stepped structure via the seam. In the present application, the disposing position of the stepped structure of the recesses is not limited. Those skilled in the art may dispose the stepped structure in different positions of the washer and/or the side wall frame according to actual situations of the speaker housing.

Optionally, in the embodiments illustrated by FIGS. 1-3, the recesses 4 are formed at two sides of the seam 3 facing the inner side of the side wall frame 1. These recesses 4 may prevent the plastic burr at the seam 3 from extending into the magnetic gap. In other embodiments of the present application, the recesses 4 may also be disposed in other positions. Taking the structure in FIG. 2 as an example, the recesses 4 may be disposed at two sides of the seam 3 facing the upper portion or the lower portion of the side wall frame 1. That is, the recesses are formed in the upper surface or the lower surface of the washer 2, so that the seam is recessed downwards or upwards for a certain distance. In this way, an assembly face will not be affected by the plastic burr at the seam when other speaker parts are disposed on the upper surface or the lower surface of the washer. Therefore, the structural stability of the speaker may be enhanced.

In addition, in practice, owing to different demands on the structure and the performance of the speaker, the structure of the side wall frame or the washer is not the same, and the seam may appear in different positions. For example, in the embodiments illustrated by the FIGS. 1-3, the seam 3 appears at two ends of the washer respectively and extends from the upper surface of the washer to the lower surface of the washer via a side surface respectively. However, in other embodiments, the seam may only appear on a side surface or the upper surface of the washer. For example, when the lower surface and the side surface of the washer are embedded into the side wall frame and only the upper surface is exposed at the inner side of the side wall frame, the seam only appears on the upper surface of the washer 2. When only one side surface of the washer is exposed from the inner side of the side wall frame, the seam only appears on the side surface of the washer.

Optionally, as shown in FIG. 1 and FIG. 3, the side wall frame 1 may be provided with four straight edges which are enclosed to form a rectangular frame structure that is easy to assemble. Preferably, the speaker housing may comprise four washers 2, disposed at four edges of the side wall frame 1 respectively when the side wall frame 1 is of the rectangular frame structure. Of course, those skilled in the art may modify the geometrical shape of the side wall frame according to actual situations to be elliptical for example. In addition, different numbers, for instance, three or five, of washers, may be disposed on the side wall frame, which is not limited by the present application.

Particularly, as shown in FIG. 1 and FIG. 2, the side wall frame 1 may be provided with a portion for supporting washer 11 which is usually located on the inner side of the side wall frame 1 to bear the washer 2. The washer 2 is disposed in the portion for supporting washer 11. In the structure of a speaker unit, it is often necessary to dispose other portions on the upper surface and the lower surface of the washer 2. The portion for supporting washer 11 may securely support the washer 2. Besides, a part of the washer 2 extends toward the inner side of the side wall frame. Thus, it is convenient to dispose components on the upper surface and the lower surface of the washer.

Figure 4:
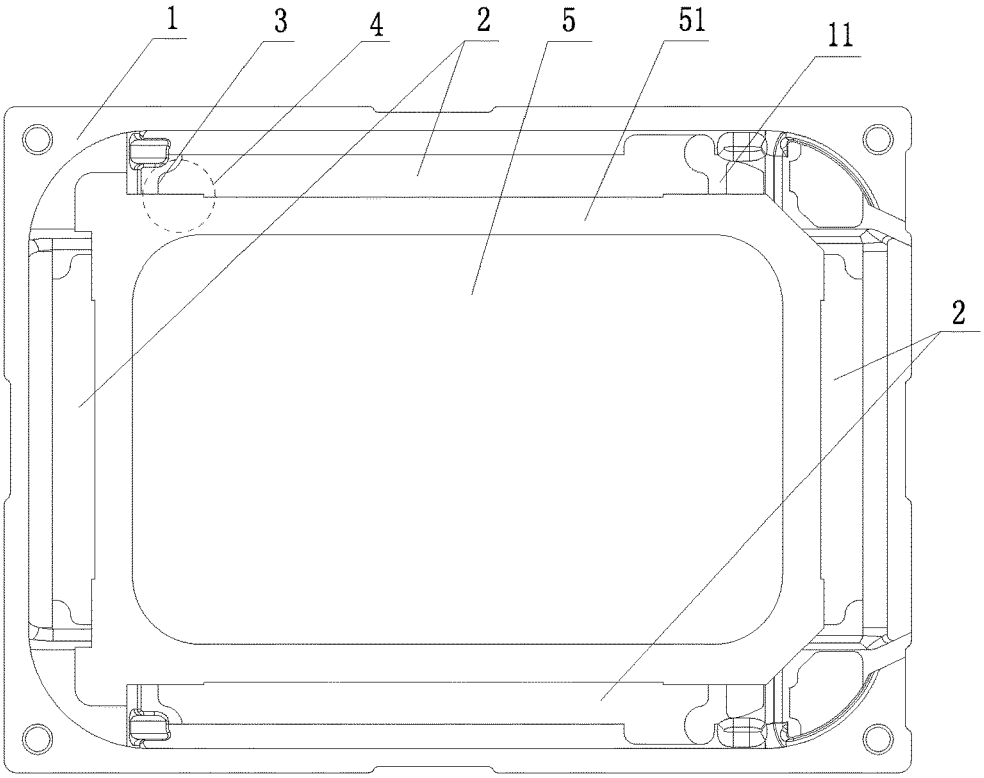
FIG. 4 is a top view of a speaker unit with a part of a magnetic circuit system in one embodiment of the present application.

Furthermore, the present application also provides a speaker unit, comprising the above-mentioned speaker housing. A vibrating component is disposed on the speaker housing. A magnetic circuit system is disposed on the inner side of the side wall frame 1. FIG. 4 is a top view of the speaker housing with a part of the magnetic circuit system. As shown in FIG. 4, a magnetic gap is formed between the magnetic circuit system and the washer 2. Owing to the recesses 4, the seam may be recessed in a direction, away from the magnetic gap, for a small distance, so that the plastic burr is prevented from extending into the magnetic gap. As a voice coil of the vibrating component is located in the magnetic gap, if the plastic burr extends into the magnetic gap, vibration of the voice coil may be affected. In the embodiment illustrated by FIG. 4, the speaker housing may prevent the plastic burr from affecting the sound performance of the speaker unit. In other embodiments of the present application, the speaker housing may also prevent the plastic burrs from affecting the mounting stability of the magnetic circuit system when the recesses are formed in the upper surface or the lower surface of the washer.

Although some specific embodiments of the present application have been described in detail by way of example, those skilled in the art should understand that the above examples are only for the purpose of illustration and are not intended to limit the scope of the present application. It will be understood by those skilled in the art that the above embodiments may be modified without departing from the scope and spirit of the present application. The scope of the present application is defined by the appended claims.

What is claimed is:

1. A speaker housing, comprising:

an enclosing side wall frame, wherein a portion enclosed by the side wall frame is an inner side of the side wall frame; and a washer, wherein the washer is integrated with the side wall frame by injection molding, at least a part of the washer is exposed at the inner side of the side wall frame, and a seam is formed between a surface of the washer exposed at the inner side of the side wall frame and a surface of the side wall frame, wherein recesses are formed in surfaces of the washer and the side wall frame at two sides of the seam, wherein the recesses are formed at two sides of the seam facing the inner side of the side wall frame.

2. The speaker housing according to claim 1, wherein the recesses are formed at two sides of the seam facing the upper portion or the lower portion of the side wall frame.

3. The speaker housing according to claim 1, wherein seams are located at both the two ends of the washer respectively.

4. The speaker housing according to claim 1, wherein the side wall frame is of a rectangular frame structure.

5. The speaker housing according to claim 4, comprising four washers respectively located at four edges of the side wall frame.

6. The speaker housing according to claim 1, wherein the side wall frame is provided with a portion for supporting washer located on the inner side of the side wall frame, and the washer is disposed in the portion for supporting washer by injection molding.

7. A speaker unit, comprising:

the speaker housing of claim 1; and a magnetic circuit system disposed on the inner side of the side wall frame and a vibrating component disposed on the speaker housing, wherein a magnetic gap is formed between the magnetic circuit system and the washer.

* * * * *